US005425651A

United States Patent [19]

Thrush et al.

[11] Patent Number: 5,425,651

[45] Date of Patent: Jun. 20, 1995

[54] CARD EDGE CONNECTOR PROVIDING NON-SIMULTANEOUS ELECTRICAL CONNECTIONS

[75] Inventors: Roger L. Thrush, Clemmons; Timothy J. Kinross, Greensboro, both of N.C.

[73] Assignee: The Whitaker Corporation, Wilmington, Del.

[21] Appl. No.: 206,356

[22] Filed: Mar. 4, 1994

[51] Int. Cl.[6] ..... H01R 13/62

[52] U.S. Cl. ..... 439/326; 439/630

[58] Field of Search ..... 439/296, 326–328, 439/629–637, 59–62, 78, 83

[56] References Cited

U.S. PATENT DOCUMENTS

| | | | |
|---|---|---|---|
| 3,795,888 | 3/1974 | Nardo et al. . | |
| 3,920,303 | 11/1975 | Pittman et al. . | |
| 4,084,874 | 4/1978 | Georgopulos | 439/326 |
| 4,185,882 | 1/1980 | Johnson . | |
| 4,298,237 | 11/1981 | Griffith et al. . | |
| 4,557,548 | 12/1985 | Thrush . | |
| 4,575,172 | 3/1986 | Walse et al. . | |
| 4,623,207 | 11/1986 | Sasaki et al. . | |
| 4,743,746 | 5/1988 | Murschall et al. | 439/326 X |
| 4,946,403 | 8/1990 | Billman et al. | 439/326 |
| 4,986,765 | 1/1991 | Korsunsky et al. | 439/326 |
| 4,996,766 | 3/1991 | Piorunneck et al. | 29/842 |
| 5,024,609 | 6/1991 | Piorunneck | 439/637 |
| 5,046,955 | 9/1991 | Olsson | 439/74 |
| 5,088,929 | 2/1992 | Enomoto | 439/66 |
| 5,112,231 | 5/1992 | Harwath et al. | 439/60 |
| 5,162,002 | 11/1992 | Regnier | 439/637 |
| 5,199,884 | 4/1993 | Kaufman et al. | 439/74 |
| 5,199,895 | 4/1993 | Chang | 439/326 |
| 5,203,725 | 4/1993 | Brunker et al. | 439/636 |
| 5,224,873 | 7/1993 | Duffet et al. | 439/326 |
| 5,292,265 | 3/1994 | Chen et al. | 439/326 X |
| 5,320,552 | 6/1994 | Reichardt et al. | 439/326 X |
| 5,337,220 | 8/1994 | Granitz | 361/816 |

*Primary Examiner*—Khiem Nguyen
*Attorney, Agent, or Firm*—Robert J. Kapalka

[57] ABSTRACT

A socket for establishing electrical connection with a circuit board comprises a dielectric housing having a board receiving slot and a plurality of terminals disposed for engaging respective contacts on the circuit board. The terminals are arranged in at least first and second sets corresponding to respective first and second sets of the contacts on the circuit board. The first set of terminals engages the first set of contacts when the circuit board is inserted into the slot in a first position, and the second set of terminals engages the second set of contacts as the circuit board is pivoted through an angle to a second position. When the circuit board is removed from the socket, the terminals of the second set disengage their respective contacts before the terminals of the first set. Thus, a socket has terminals arranged such that a portion of the terminals provide make first, break last electrical interconnections.

4 Claims, 5 Drawing Sheets

CARD EDGE CONNECTOR PROVIDING NON-SIMULTANEOUS ELECTRICAL CONNECTIONS

FIELD OF THE INVENTION

The invention relates to an electrical connector for coupling a printed circuit daughterboard to a printed circuit motherboard, and more particularly, to such a connector having a plurality of terminals wherein some of the terminals engage their respective contacts on the daughterboard before others of the terminals.

BACKGROUND OF THE INVENTION

Card edge connectors are well-known for electrically connecting circuit traces on a daughterboard with mating circuit traces on a motherboard. A daughterboard generally comprises a circuit board having a plurality of electronic devices mounted thereon and having electrical circuitry which terminates in contact pads disposed on spaced apart centers along an edge portion of the board. The card edge connectors generally comprise a housing which defines a slot dimensioned to receive the edge portion of the circuit board, and terminals having one or more contact portions which extend into the slot for engagement with the contact pads of the circuit board. The terminals are disposed on spaced apart centerlines corresponding to the spacing of the contacts along the edge of the circuit board. Such a connector is disclosed in U.S. Pat. No. 4,557,548 wherein each of the terminals has a pair of spring contact arms extending into the slot, the arms being electrically joined to a common lead.

It is known to provide a card edge connector with multiple terminals at each terminal centerline for engagement with respective contact pads which are disposed on opposite sides of the board at different distances from the board edge. See, for example, U.S. Pat. Nos. 4,298,237 and 5,024,609. These patents disclose high-density connectors wherein multiple terminals on a common centerline have spring arms which extend to different levels above a bottom of the slot for engaging respective contact pads which are disposed at different distances from the insertion edge of the circuit board. In each of these connectors, the daughterboard in inserted into the slot with a straight line motion, and all of the terminals engage their respective contact pads simultaneously as the daughterboard is fully seated in the connector.

A problem with high-density, direct insertion connectors is that the sum of the forces exerted by the individual spring arms is quite large, thereby resulting in considerable resistance to insertion or removal of the daughterboard. In order to overcome this problem, card edge connectors requiring a zero or low insertion force have been developed. See, for example, U.S. Pat. Nos. 3,795,888; 3,920,303; 4,185,882; and 4,575,172. Each of these patents discloses a connector wherein a circuit board can be inserted into the connector at a first angular position against little or no resistance, and the circuit board can be pivoted to a second angular position wherein the terminals are deflected in opposition to their spring force. Pivoting insertion substantially reduces friction of the terminals against their contacts as compared to straight line, or direct, insertion, and provides a mechanical advantage which enables easier deflection of the spring contact arms.

The low insertion force card edge connectors have been limited as to the number of terminals which they could accommodate on an individual terminal centerline. U.S. Pat. No. 4,946,403 discloses a low insertion force circuit panel socket wherein individual terminals are spaced on separate centers and each terminal has a pair of contact springs which engage opposite sides of the circuit board.

Another problem with high-density connectors is that closely spaced terminals are more susceptible to electromagnetic induction and cross-talk. Also, the high density connectors can transmit signals at a high rate of speed, but the faster signals generate greater spikes of electromagnetic impulse which are more likely to generate cross-talk between adjacent or proximate terminals.

The connector terminals may connect with either power, signal, or ground circuitry on the daughterboard. In order to prevent stray electromagnetic impulses from damaging electronic components on the daughterboard, it would be advantageous for the power and ground circuits to be complete before the signal terminals are electrically connected. This would give stray impulse spikes from the signal circuitry a straight path to electrical ground. As previously discussed, the connectors disclosed in the '237 and '609 patents have terminals which engage all of their respective contact pads simultaneously as a daughterboard is inserted therein.

The present invention provides a low insertion force card edge connector, or socket, having multiple terminals on each terminal centerline. The terminals are arranged such that some of the terminals will engage their respective contacts on the daughterboard before others of the terminals, thereby providing a connector with make first, break last terminal connections.

SUMMARY OF THE INVENTION

It is an object of the invention to provide a low insertion force connector having increased terminal density.

It is another object of the invention to provide a low insertion force connector having multiple terminals on each terminal centerline.

It is yet another object of the invention to reduce stray signal transmission in a high-density connector.

It is still another object of the invention to provide a low profile, high-density connector.

These and other objects are accomplished by an electrical connector comprising a dielectric housing having a circuit board receiving slot and a plurality of terminals for engaging respective contacts on the circuit board. The terminals are arranged in at least first and second sets corresponding to respective first and second sets of the contacts. The terminals are arranged such that the first set of terminals engages the first set of contacts when the circuit board is inserted into the slot in a first position, and the second set of terminals engages the second set of contacts as the circuit board is pivoted through an angle to a second position. The socket further includes a latch means for retaining the circuit board in the second position.

In one embodiment, the slot is defined by a bottom surface and a pair of opposite side walls. The first set of terminals includes terminals which extend into the slot through one of the side walls at a distance from the bottom surface. The terminals of the second set extend into the slot through the one side wall at a greater distance from the bottom surface than the terminals of the first set. The first set of terminals may also include terminals which extend into the slot through the other of the side walls.

BRIEF DESCRIPTION OF TEE DRAWINGS

The invention will now be described by way of example with reference to the accompanying drawings in which like elements in different figures thereof are identified by the same reference numeral and wherein.

DETAILED DESCRIPTION OF TEE PREFERRED EMBODIMENT

Figure 1:
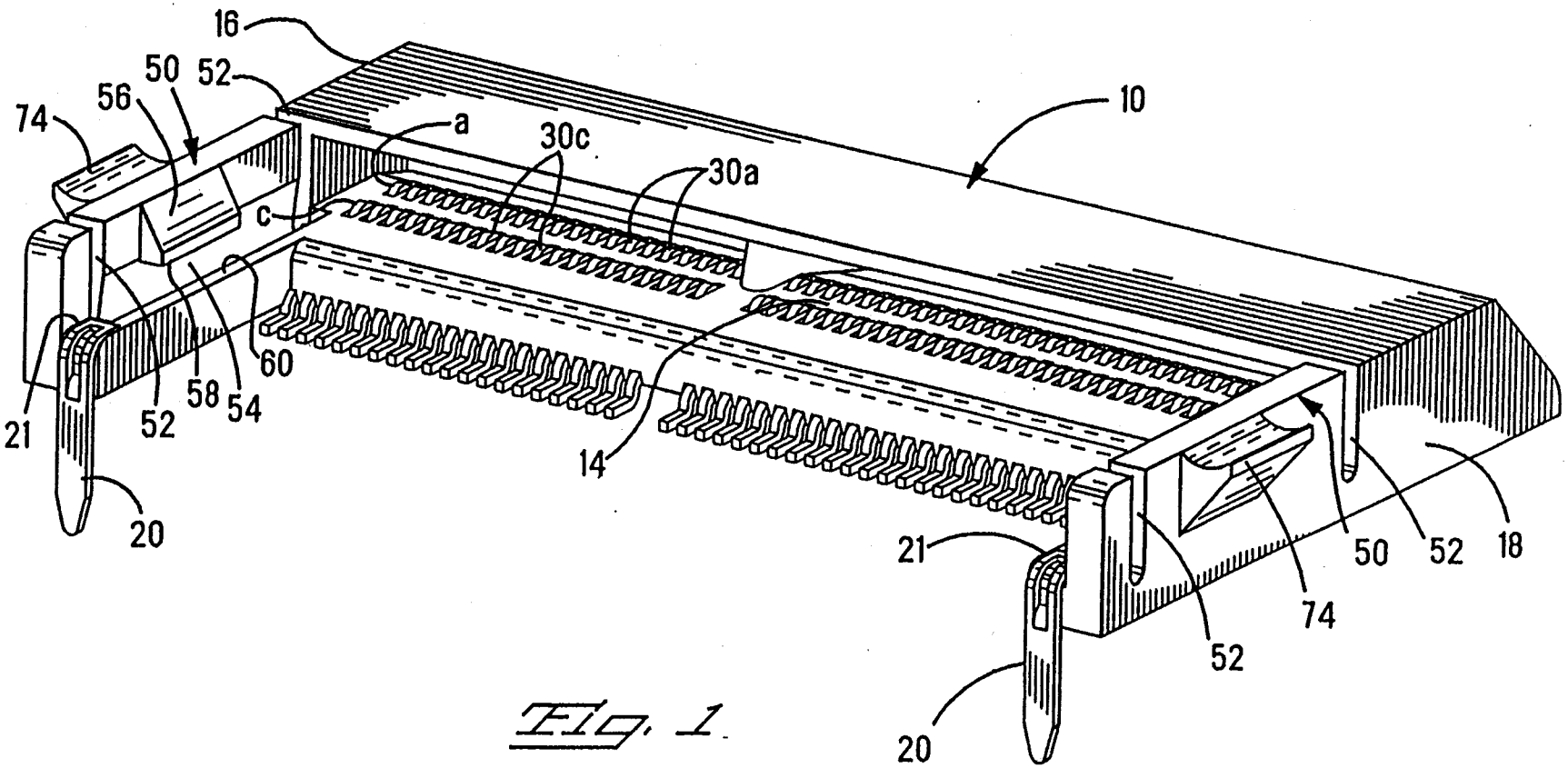
FIG. 1 is a perspective view of a socket according to the invention.
Figures 2, 3:
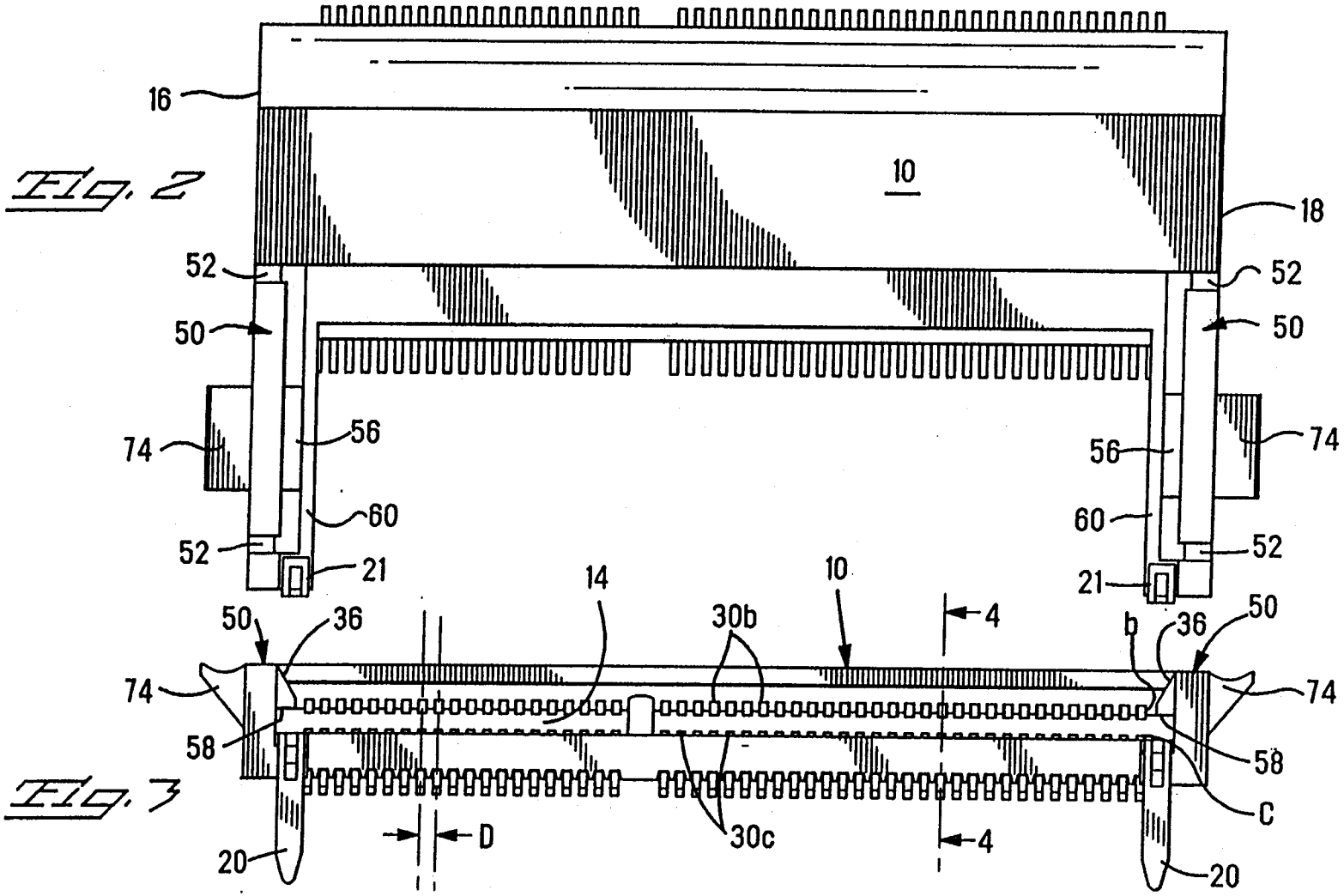
FIG. 2 is a top plan view of the socket.
FIG. 3 is a front view of the socket.
Figure 4:
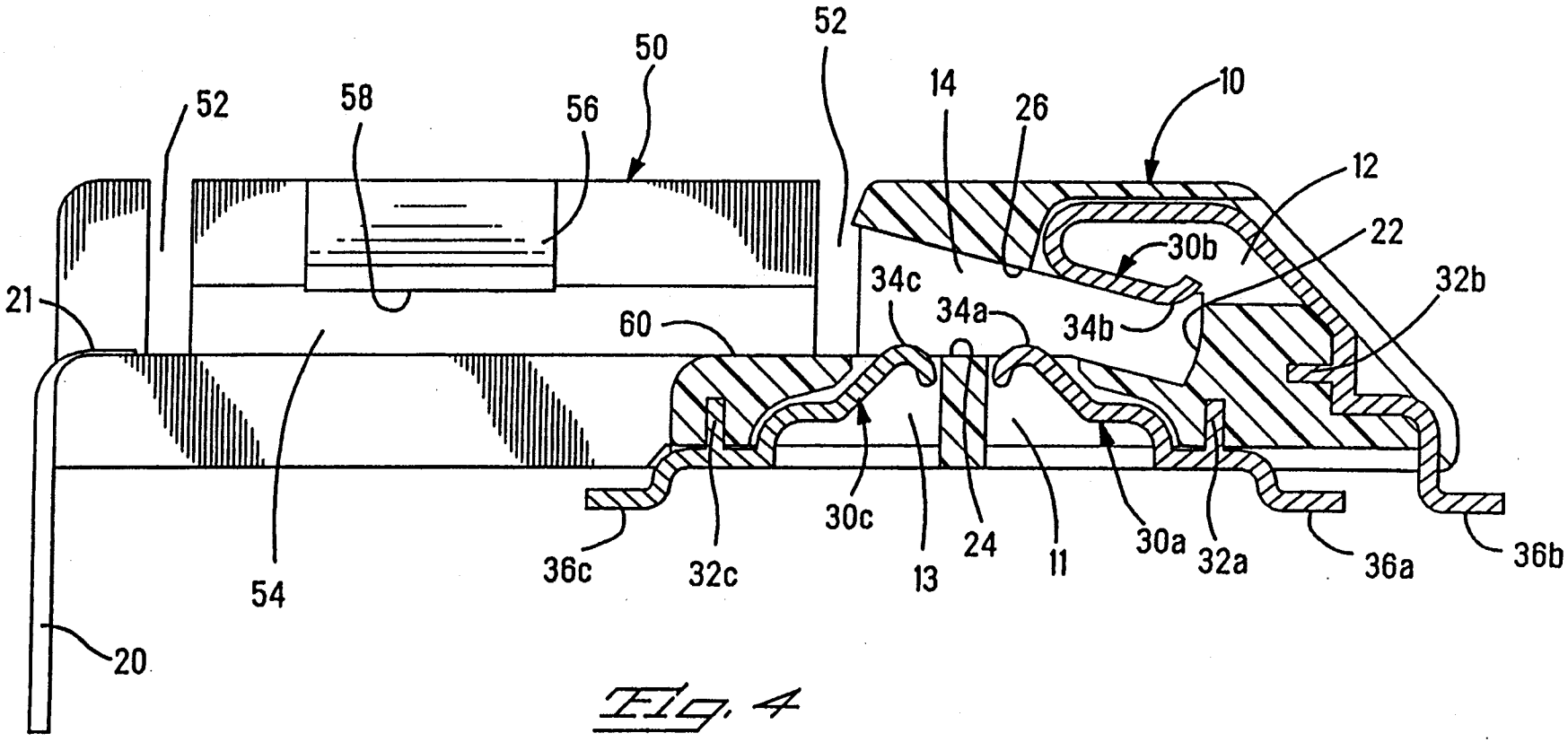
FIG. 4 is a cross-sectional view taken along line 4—4 of FIG. 3.

A socket according to the invention as shown in FIGS. 1–4 comprises a housing 10 made from a suitable dielectric material. The housing 10 defines a daughterboard receiving slot 14 which has a length extending between opposite ends 16 and 18 of the housing 10. The housing 10 holds a plurality of terminals in individual terminal receiving cavities which are disposed for electrically mating with contact pads on a daughterboard which can be received in the slot 14. The plurality of terminals is arranged in at least two sets such that, as the daughterboard is inserted into the slot 14, one of the sets will engage its respective contacts on the daughterboard before the other of the sets, all of which will be described more fully hereinafter.

In a preferred embodiment as shown in the drawings, the plurality of terminals is arrayed in three linear rows a, b, c. Each of the rows includes a respective plurality of terminals 30*a*, 30*b*, 30*c*, the terminals in each of the rows being disposed on respective spaced apart terminal centerlines D along the length of the slot 14. As shown in the drawings, the centerlines D are coincident such that three terminals, one from each of the rows a, b, c, is disposed on each terminal centerline D. Alternatively, the terminals in different rows may be on different centerline spacings, or the terminals in one row may be on centerlines which are offset from the centerlines of terminals in another row, or the terminals may be arrayed in non-linear configurations, and these and other arrangements of the terminals are considered to be within the scope of the invention.

In the embodiment shown, a first set of terminals comprises the terminals 30*a*, 30*b* in the rows a, b, and a second set of terminals comprises the terminals 30*c* in the row c. The terminals 30*a*, 30*b*, 30*c* reside in respective cavities 11, 12, 13 in the housing 10, and are retained in the housing 10 by respective retention members 32*a*, 32*b*, 32*c* which are sized to grip walls of complementary apertures defined by the housing 10. The terminals 30*a*, 30*b*, 30*c* have respective contact engaging portions 34*a*, 34*b*, 34*c* which extend into the slot 14 for engaging respective contacts on a daughterboard, and respective leads 36*a*, 36*b*, 36*c* which may be surface mount soldered to a motherboard.

The slot 14 is defined by a bottom surface 22 and opposite side walls 24, 26. The first set of terminals includes the terminals 30*a* having the contact engaging portions 34*a* which extend into the slot 14 through the side wall 24 at a distance from the bottom surface 22. The second set of terminals includes the terminals 30*c* having the contact engaging portions 34*c* which extend into the slot 14 through the side wall 24 at a greater distance from the bottom surface 22 than the contact portions 34*a* of the first set. Thus, the terminals 30*a* and 30*c* extend into the slot 14 at different relative distances from the bottom surface 22.

The first set of terminals also includes the terminals 30*b* having the contact engaging portions 34*b* which extend into the slot 14 through the side wall 26. When a daughterboard is inserted into the socket housing the first set of terminals 30*a*, 30*b* engages a respective first set of contacts on the daughterboard before the second set of terminals 30*c* engages a respective second set of contacts.

Figure 5:
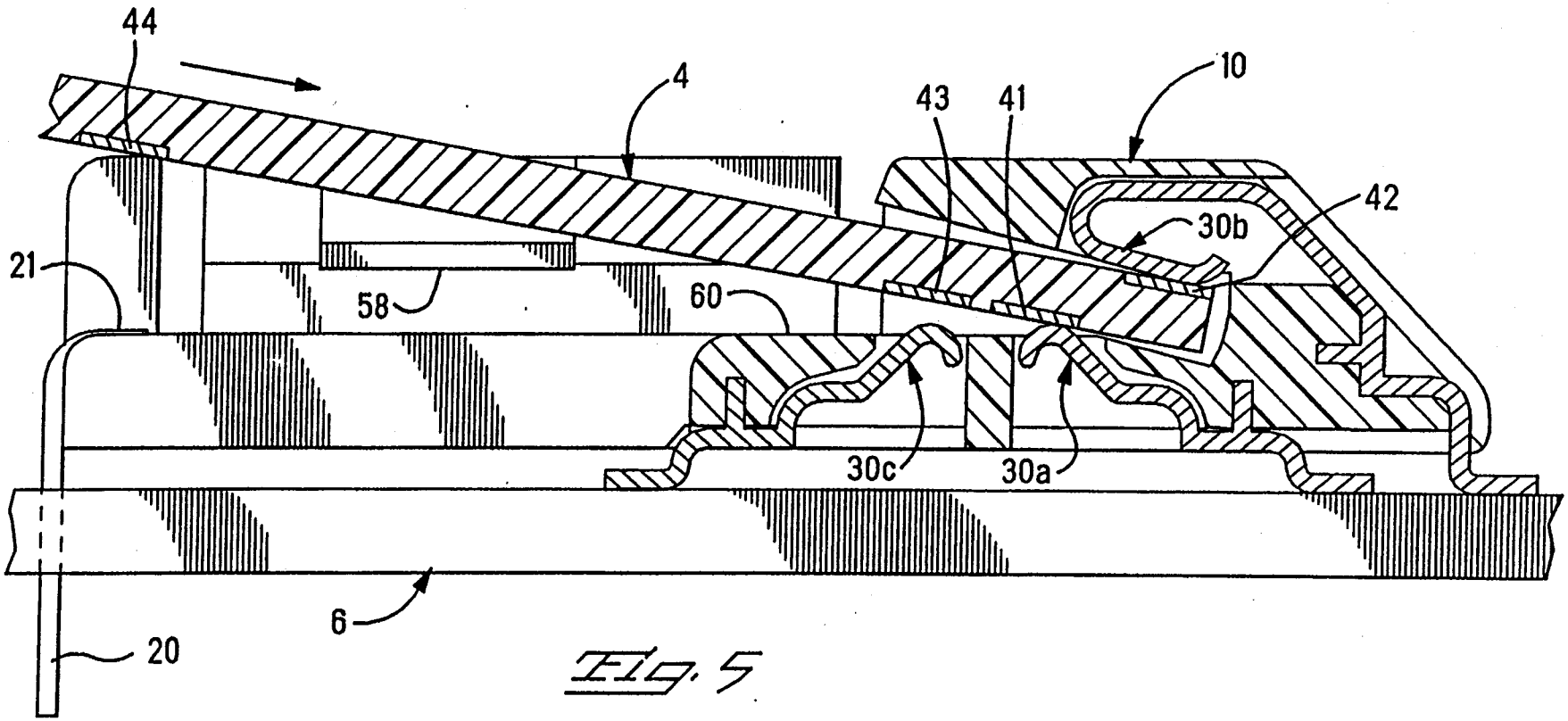
FIG. 5 is a cross-sectional view similar to FIG. 4 showing a circuit board having been linearly inserted into the socket and disposed in a first position.
Figure 6:
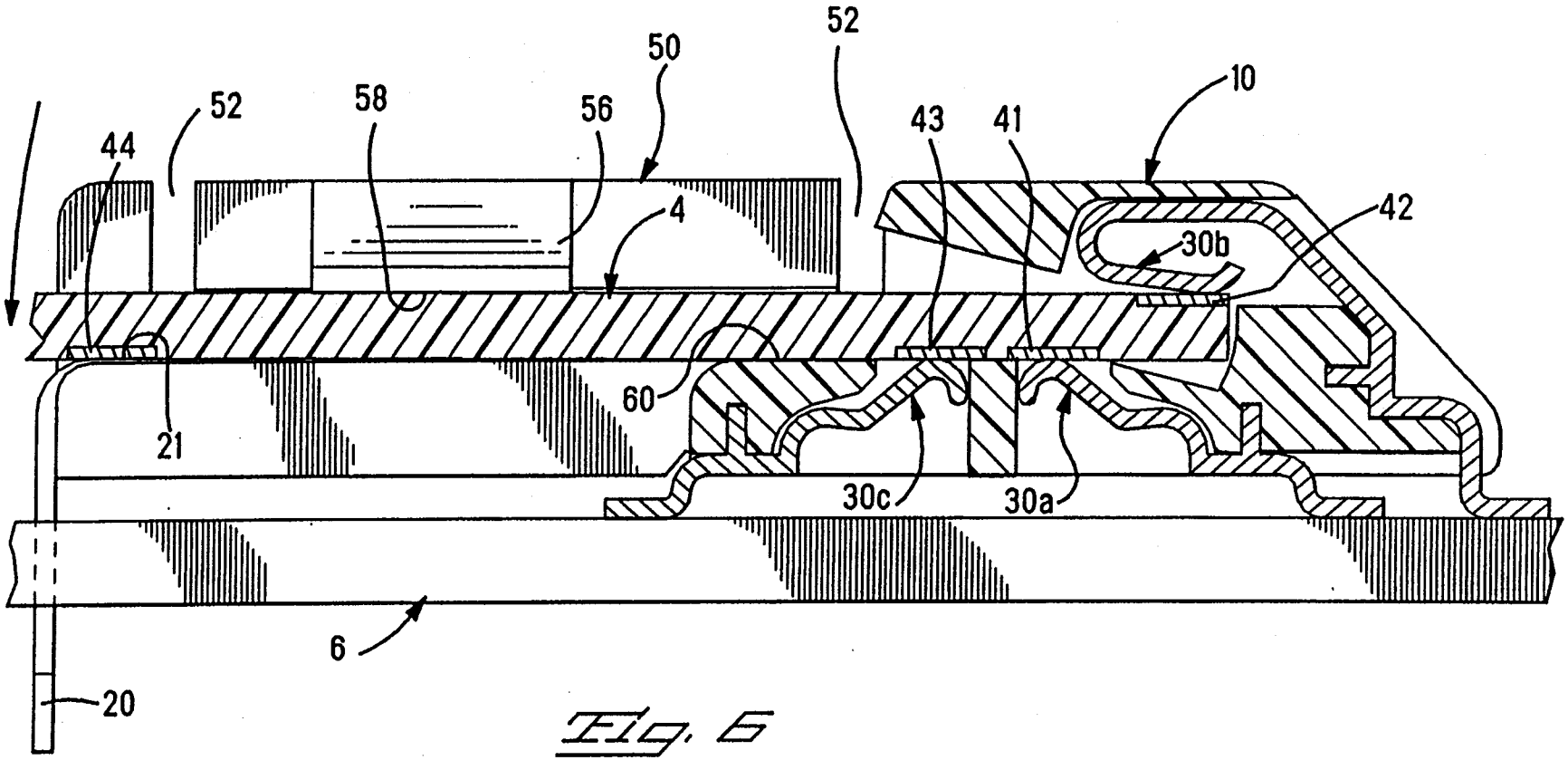
FIG. 6 is a cross-sectional view showing the circuit board having been pivoted through an angle and disposed in a second position.

FIGS. 5 and 6 illustrate insertion of a daughterboard 4 into a socket according to the invention which is mounted on a motherboard 6. In FIG. 5, the daughterboard 4 has been inserted into the slot 14 with a linear motion as indicated by the arrow and is residing in a first position. A first set of contacts on the daughterboard 4 comprises contacts 41, 42 which are engaged by the terminals 30*a*, 30*b*, respectively, when the daughterboard 4 is disposed in the first position. The contacts 41, 42 may include both power and ground contacts of associated power and ground circuits on the daughterboard 4. Thus, power and ground connections are made first between the daughterboard 4 and the motherboard 6.

Insertion of the daughterboard 4 into the socket housing 10 is completed by pivoting the daughterboard 4 through an angle to a second position, as shown in FIG. 6, thereby resiliently deflecting the contacts 30*a*, 30*b*, 30*c*. In the second position, the terminals 30*c* of the second set engage a respective second set of contacts comprising contacts 43 on the daughterboard 4. The contacts 43 are, for example, signal contacts of associated signal circuits on the daughterboard 4. Since the power and ground connections between the daughterboard 4 and motherboard 6 are completed before the signal connections, a stray signal resulting from electromagnetic induction is more likely to have a straight path to electrical ground, thus decreasing the possibility that electronic components on the daughterboard 4 may be damaged or destroyed.

The socket includes a latch means for retaining the daughterboard 4 in the second position in opposition to the reaction force of the elastically deflected contacts 30*a*, 30*b*, 30*c*. The latch means includes a pair of latch members 50 which are integrally molded with the socket housing 10. Each of the latch members 50 is bounded by a pair of slits 52 and is flexibly connected to the housing 10 by a connecting portion 54 which may have a reduced thickness in order to increase flexibility between the latch member 50 and the housing 10. Each of the latch members 50 has a projection defining a camming surface 56 and a shoulder 58. As the daughterboard 4 is rotated from the first position to the second position, edges of the daughterboard engage both of the camming surfaces 56 and cause the latch members 50 to flex outwardly. When the edges of the daughterboard pass beyond the shoulders 58, the latch members 50 snap back to their unstressed positions, and the daughterboard is confined between the shoulders 58 and seating surfaces 60.

Alternatively, the latch members 50 may be separate articles which are formed from a strong yet flexible material such as thin gauge sheet metal and which are firmly attached to the housing 10.

Tabs 74 are finger grippable members which enable the latch members 50 to be flexed outwardly, thereby increasing a space between the latch members 50 so that the daughterboard 4 can be released from behind the shoulders 58 and removed from the socket housing 10.

The daughterboard 4 is removed from the socket housing 10 in a reverse manner from the insertion, that is, the daughterboard is first pivoted from the second position shown in FIG. 6 to the first position shown in FIG. 5, and then withdrawn linearly from the socket. During the removal, the signal terminals 30*c* are disengaged from their respective contacts 43 before the power and ground terminals 30*a*, 30*b* are disengaged from their respective contacts 41, 42. Thus, the invention provides a socket having a plurality of terminals arranged such that a subset of the terminals will "make first, break last" their respective electrical interconnections.

The socket may further include ground terminals 20 having contact engaging portions 21 arranged to engage ground contacts 44 on the daughterboard 4 when the daughterboard is fully inserted in the socket. The ground terminals 20 may be electrically connected to a ground plane of the motherboard 6 such as by soldering.

The invention provides a socket having a number of advantages. The socket has a high terminal density in a low profile package due to multiple terminals on closely spaced centerlines, yet a relatively low force is required to insert a circuit board in the socket. The invention reduces stray signal transmission in a high-density connector, and provides a socket having terminals arranged such that some of the terminals constitute a subset of terminals which provide make first, break last electrical interconnections.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A socket for establishing electrical connection with a circuit board, comprising:

a dielectric housing having a board receiving slot defined by a bottom surface and opposite side walls, and a plurality of terminals disposed for engaging respective contacts on the circuit board, the terminals being arranged in at least first and second sets corresponding to respective first and second sets of the contacts, the first set of terminals including terminals which extend through one of the side walls at a distance from the bottom surface and which are arranged to engage the first set of contacts when the circuit board is inserted into the slot in a first position, and the second set of terminals including terminals which extend through the other of the side walls at a different distance from the bottom surface and which are arranged to engage the second set of contacts as the circuit board is pivoted through an angle to a second position.

2. The socket according to claim 1, further comprising at least one ground terminal arranged to engage a ground region of the circuit board when the circuit board is in the second position.

3. A socket for establishing electrical connection with a circuit board, comprising:

a dielectric housing having a board receiving slot and a plurality of terminals extending into the slot through respective opposite sides thereof for engaging respective contacts on the circuit board, the terminals being arranged at respective different distances from a bottom of the slot such that a subset of the terminals including terminals on both of the sides engage their respective contacts when the circuit board is inserted into the slot in a first position, and all of the terminals on both of the sides engage their respective contacts when the circuit board is pivoted through an angle to a second position.

4. The socket according to claim 3, further comprising at least one ground terminal arranged to engage a ground region of the circuit board when the circuit board is in the second position.

* * * * *